US012799727B2

(12) United States Patent
Sas

(10) Patent No.: US 12,799,727 B2
(45) Date of Patent: Nov. 17, 2026

(54) TOILET BOWL CAVITY VENTILATION SYSTEM

(71) Applicant: Ioan Sas, Buşteni (RO)

(72) Inventor: Ioan Sas, Buşteni (RO)

( * ) Notice: Subject to any disclaimer, the term of this patent is extended or adjusted under 35 U.S.C. 154(b) by 0 days.

(21) Appl. No.: 18/711,042

(22) PCT Filed: Nov. 16, 2022

(86) PCT No.: PCT/RO2022/000012
§ 371 (c)(1),
(2) Date: May 16, 2024

(87) PCT Pub. No.: WO2023/091039
PCT Pub. Date: May 25, 2023

(65) Prior Publication Data

US 2025/0012066 A1 Jan. 9, 2025

(30) Foreign Application Priority Data

Nov. 17, 2021 (RO) ..... a 2021 00690

(51) Int. Cl.
*E03D 9/052* (2006.01)

(52) U.S. Cl.
CPC ..... *E03D 9/052* (2013.01)

(58) Field of Classification Search
CPC ..... E03D 9/052
See application file for complete search history.

(56) References Cited

U.S. PATENT DOCUMENTS 5,704,074 A * 1/1998 Baldea ..... E03D 9/052 4/219
11,293,172 B1 * 4/2022 Jones ..... E03D 9/052
2002/0194670 A1 12/2002 Hashemi
2009/0126089 A1 * 5/2009 Smith ..... E03D 9/05 4/213
2017/0198465 A1 * 7/2017 Crisp ..... E03D 11/13

FOREIGN PATENT DOCUMENTS

| | | | |
|---|---|---|---|
| CA | 2323534 | A1 | 4/2001 |
| DE | 19747522 | A1 | 6/1999 |
| RO | 130981 | B1 | 3/2016 |
| WO | 2011153637 | A1 | 12/2011 |

OTHER PUBLICATIONS

International Search Report for PCT/RO2022/000012, mailed Mar. 20, 2023, 3 pages.
Written Opinion of the ISA for PCT/RO2022/000012, mailed Mar. 20, 2023, 7 pages.

* cited by examiner

*Primary Examiner* — Janie M Loeppke

(57) ABSTRACT

A toilet bowl cavity ventilation system usable for ventilating spaces intended for individual toilets or bathrooms. The system comprises a toilet vent pipe (22) with a fan (23) and a ventilation device (32) interposed between the water tank (31) and the flush pipe (29), or connected in-line into the flush pipe (29). The ventilation device (32) comprises a cylindrical main body (1) coaxially mounted within a secondary body (2). A fixed grooved bushing (4) is mounted at the upper part, beneath which a cylindrical sliding bushing shutter (3) is connected by a threaded rod (6) and nuts (27) to a rod end-piece (5) at the top of the flush valve tube (9). Radial apertures (a) in the main body (1) exhaust malodorous air through the secondary body (2). A vent tee (20) with an access cover (21) allows periodic sanitation of the malodorous air circuit.

5 Claims, 18 Drawing Sheets

TOILET BOWL CAVITY VENTILATION SYSTEM

FIELD

The invention relates to a toilet bowl cavity ventilation system, which can also be used for ventilation of spaces intended for individual toilets or bathrooms.

BACKGROUND

A ventilation system for extracting malodorous air from the inside of a bathroom is disclosed in document US 2002/0194670 A1. The system is mounted inside the water tank and includes an odor drain from the toilet, an automatic flushing device, and a steam and moisture ventilation device for the bathroom or toilet, the latter having a motor and a fan connected to the odor drain. The system further comprises an inverted U-shaped outlet connected to the tank water outlet, and a passage part arranged at the bottom of the tank, the passage part extending to the outside of the tank and being fitted with a fan.

Another system for ventilating a toilet bowl cavity is disclosed in document WO 2011/153637 A1. The system is mounted inside a water tank and comprises an adapter having two chambers that are open at the bottom and communicate with each other through an opening. The lower portions of the two chambers are situated below the water level in the tank.

Document RO 130981 B1 discloses a ventilation system that uses the exhaust path of a tank's water drainage circuit in the reverse direction, employing a fan located at the end of the exhaust path. In one embodiment, the system comprises a sealed chamber having two pairs of holes arranged along a vertical axis, through which cylinders pass. The cylinders carry interconnected sliding pistons and are provided with corresponding windows therebetween.

Such conventional ventilation systems require major modifications to the water drain assembly of the flush tank, cause unnecessary extraction of air and water from the tank, and create a risk of water penetrating into the ventilation circuit, or of reverse air circulation occurring when the fan is not operating.

SUMMARY

The technical problem solved by this invention is the efficient ventilation of the toilet bowl cavity, toilet cubicles, and bathrooms.

A ventilation system according to this invention solves the proposed problem and comprises a ventilation device either interposed between a water tank and a flush pipe, or fluidly connected in-line between two sections of the flush pipe. The ventilation device comprises a main body having a longitudinally grooved interior, a secondary body surrounding the main body, a cylindrical sliding bushing shutter having a grooved profile on the outside and a resistance profile on the inside, and a fixed grooved bushing having a grooved profile on the outside and, on the inside, a resistance profile identical to that of the cylindrical sliding bushing shutter. The cylindrical sliding bushing shutter is positioned inside the main body and is connected by a threaded rod and nuts to a rod end-piece at the top of the flush valve tube. At the upper part of the main body, the fixed grooved bushing has a conjugate profile with the main body's interior, whose inner resistance profile takes the stress of the water flush by means of its two-sloped, roof-shaped profile. Radial apertures in the main body communicate with the surrounding secondary body, which may be round, square, or any other shape. To prevent the incomplete flushing of the tank caused by the added weight of the moving assembly, the weight is balanced either by a counterweight on the flush lever or by a pulley assembly fixed to the tank wall by a pulley support bracket and a pulley support arm; a wire passes over the pulley, carrying a counterweight at one end, while its other end is fixed to a wire-fixing support through a wire end-piece. When the fan is on and the flush lever is not actuated, the malodorous air from the toilet bowl cavity is exhausted through the flush pipe, the main body, the cylindrical sliding bushing shutter, the apertures, the secondary body, a toilet vent pipe, a vent tee being provided with an access cover for periodic sanitation of the malodorous air circuit, a fan and a backdraft damper that prevents reverse air circulation when the fan is not operated; the fan is mounted inside the toilet vent pipe by means of end spacer rings, and cooling slots are located in line with the fan. When the flush lever is actuated, the flush valve tube and the rod end-piece are raised and, through the threaded rod secured by the nut, the cylindrical sliding bushing shutter is raised, closing the apertures and completely separating the malodorous air circuit from the water flush circuit; the water then flows from the tank, through the center of the fixed grooved bushing and the cylindrical sliding bushing shutter and through the flush pipe, into the toilet bowl cavity.

BRIEF DESCRIPTION OF THE DRAWINGS

In the following, an embodiment of the invention is presented with reference to FIGS. 1 to 19, representing.

DETAILED DESCRIPTION

Figure 1:
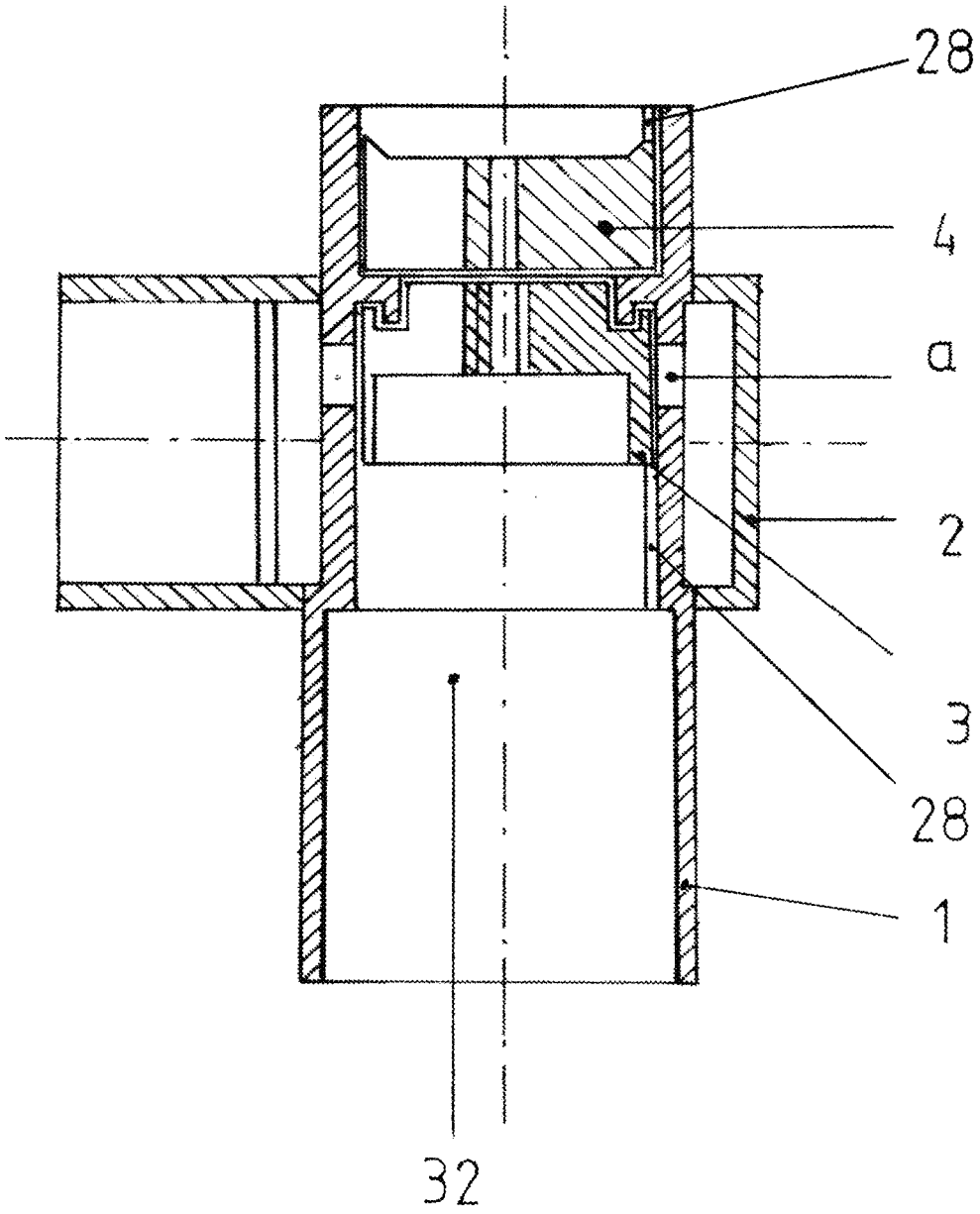
FIG. 1—Section through the ventilation device 32
Figure 2:
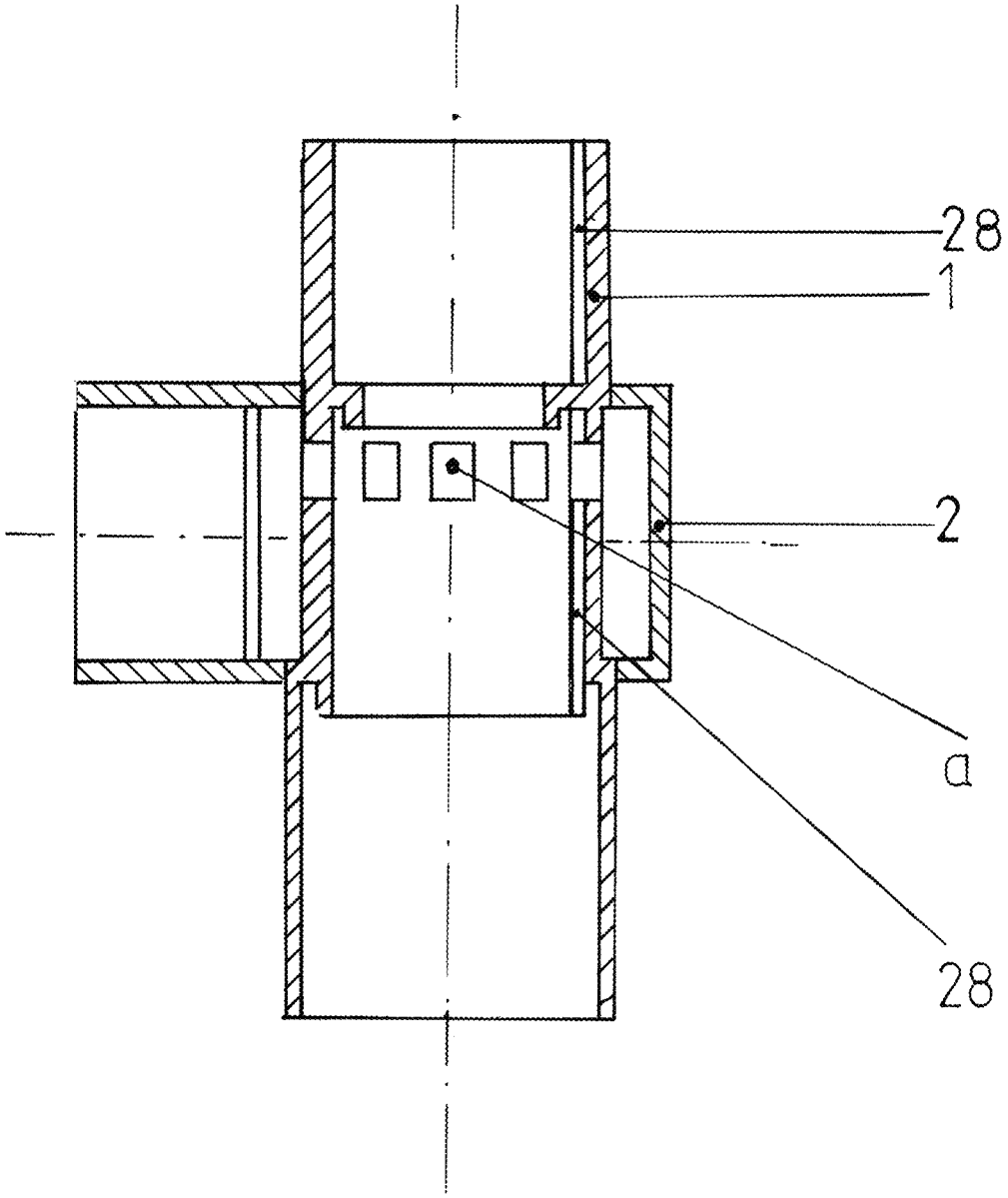
FIG. 2—Section through the main body 1 and secondary body 2
Figure 3A:
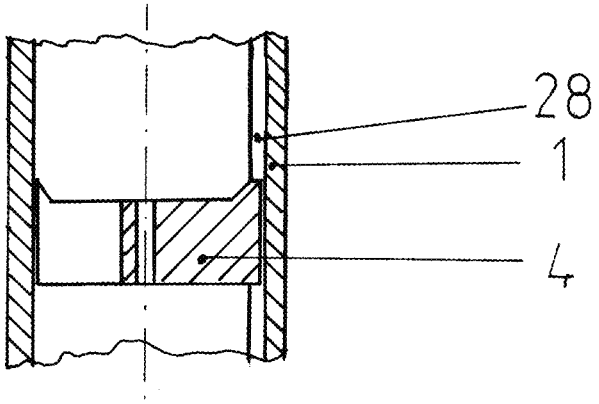
FIG. 3A—Section through the fixed grooved bushing 4 and main body 1
Figure 3B:
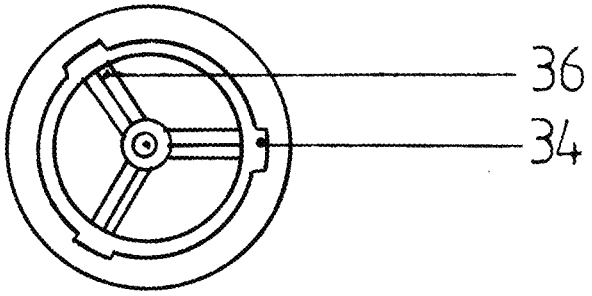
FIG. 3B—View of the grooves 34 and resistance profile 36 of the fixed grooved bushing 4
Figure 3C:
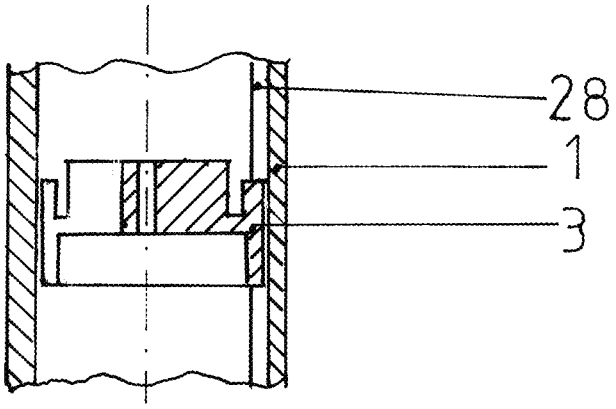
FIG. 3C—Section through the cylindrical sliding bushing shutter 3 and main body 1
Figure 3D:
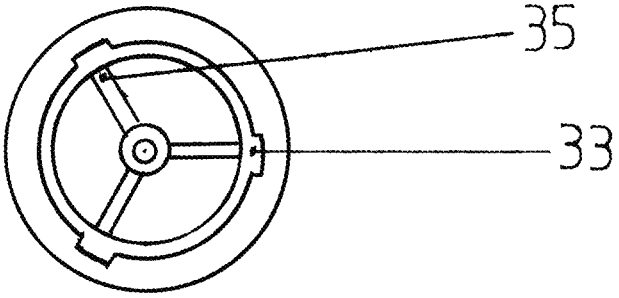
FIG. 3D—View of the grooves 33 and resistance profile 35 of the cylindrical sliding bushing shutter 3
Figure 4A:
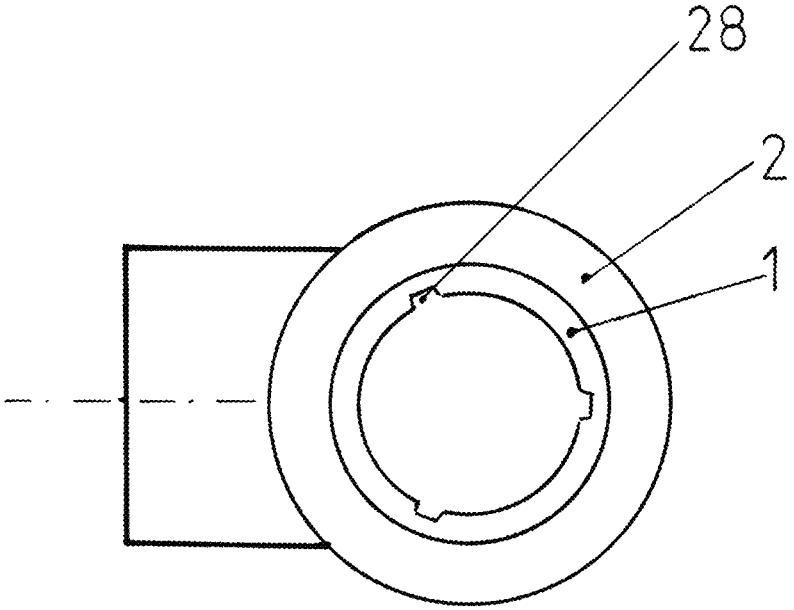
FIG. 4A—Top view of the assembly of the main body 1 and the secondary body 2, round variant FIG. 4B—Top view of the assembly of the main body 1 and the secondary body 2, square variant FIG. 5A—Section through the rod end-piece 5
Figure 4B:
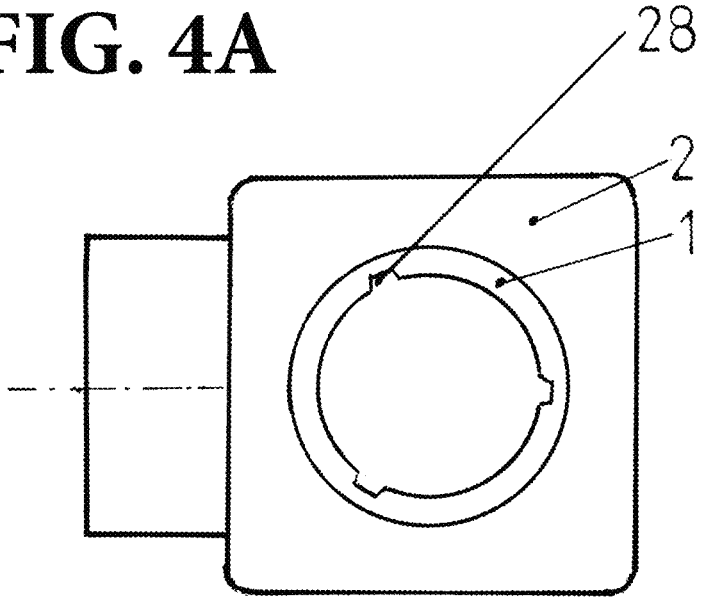
Figure 5A:
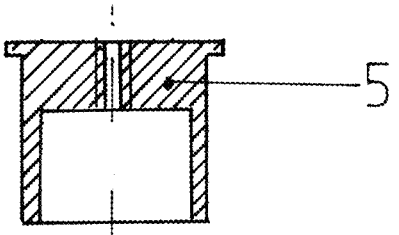
FIG. 5B—Section through the rod end-piece 5, nut 27, threaded rod 6 and the flush valve tube 9
FIG. 5C—View of the threaded rod 6
Figure 5B:
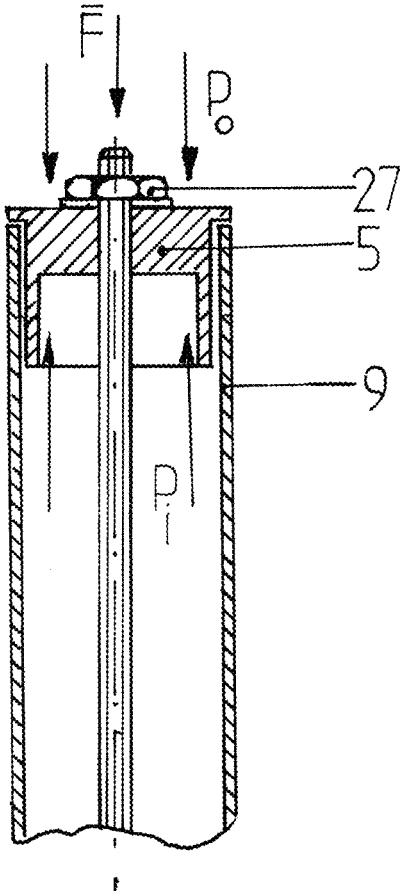
Figure 5C:
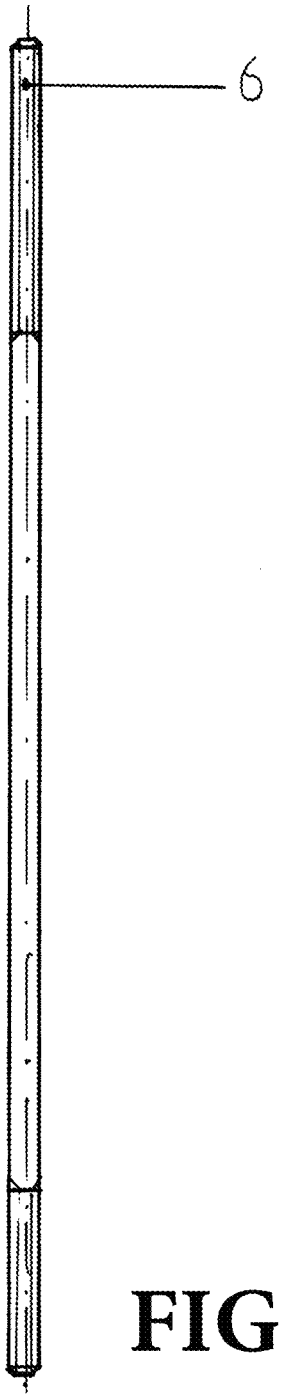
Figure 6:
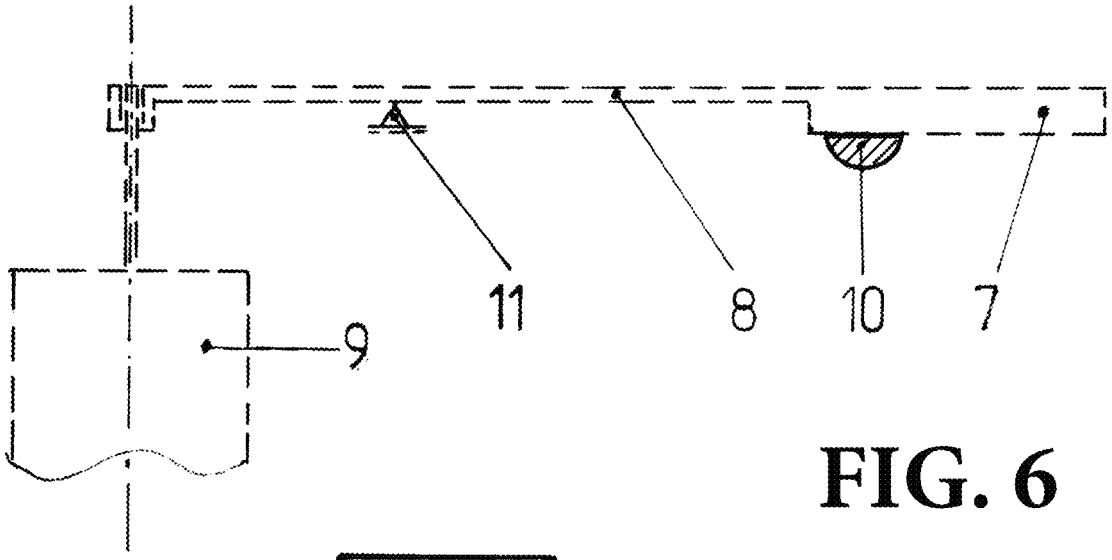
FIG. 6—Section through the flush lever 7
Figure 8:
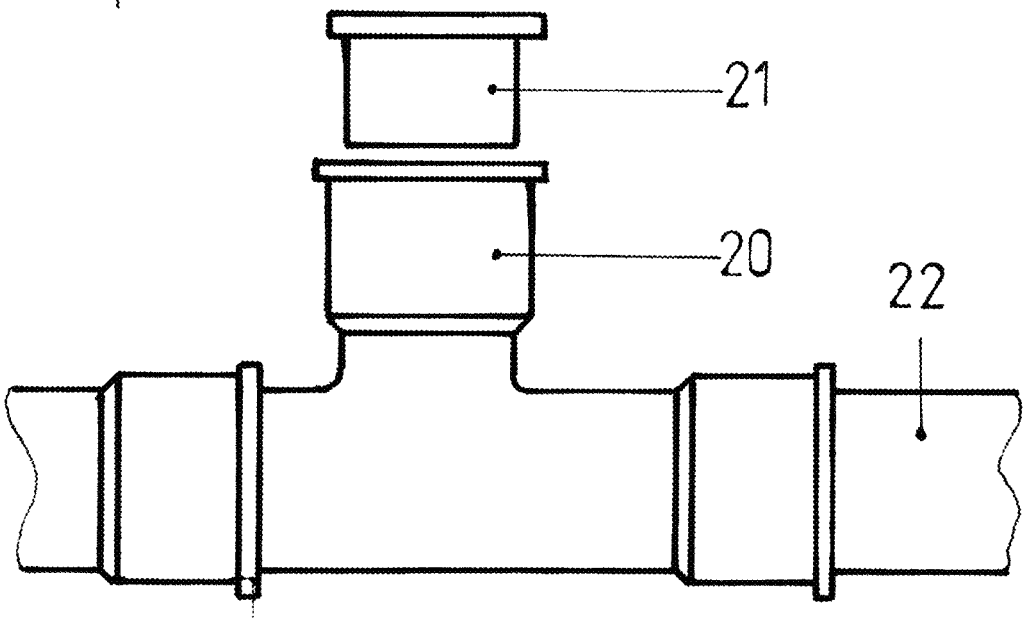
FIG. 8—View of the vent tee 20
Figure 7B:
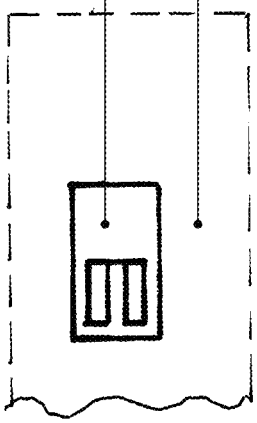
FIG. 7B—View of the wire-fixing support 18 fixed on the flush valve tube 9
Figure 7A:
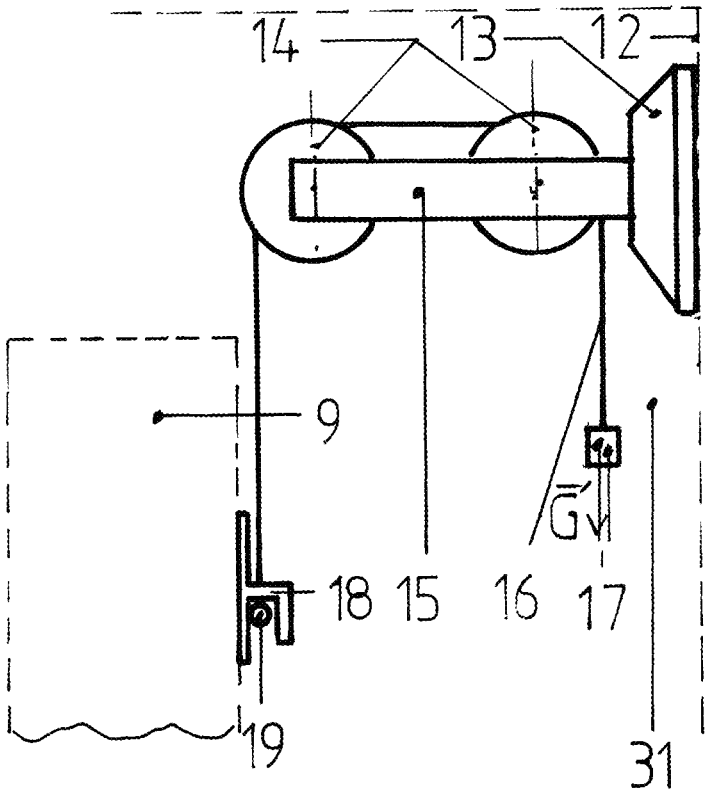
FIG. 7A—View of the flush valve tube 9 and the pulley assembly
Figure 7C:
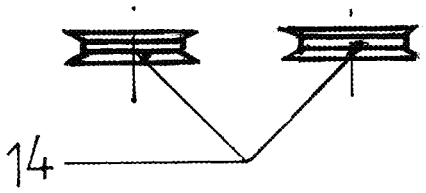
FIG. 7C—View of the pulley 14
Figure 9A:
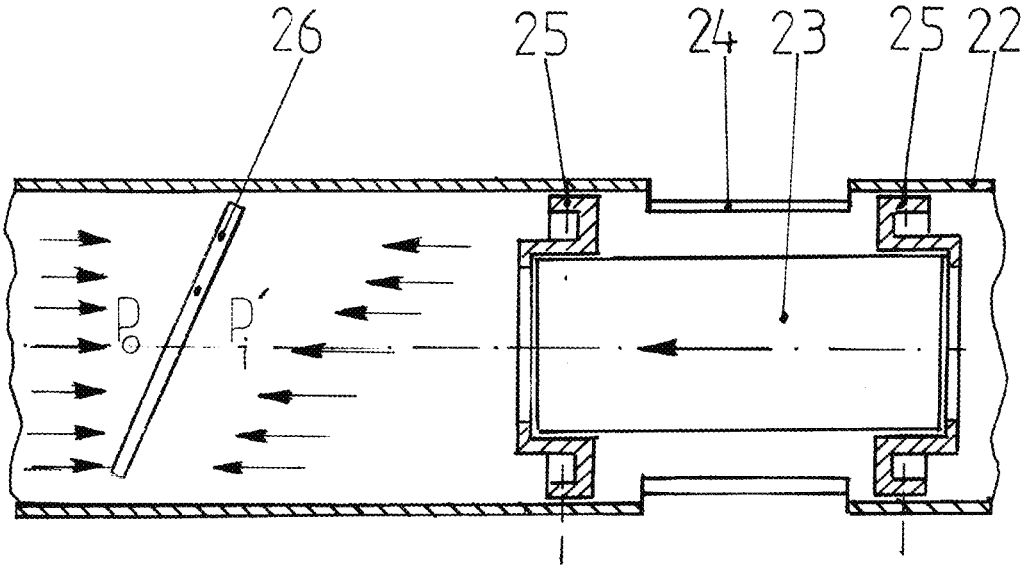
FIG. 9A—Toilet vent pipe 22 section, with the fan 23 and the backdraft damper 26 in the open position FIG. 9B—Toilet vent pipe 22 section, with the fan 23 and the backdraft damper 26 in the closed position FIG. 10—Longitudinal section through device 32, air-flow variant FIG. 11—Cross-section A'-A' through device 32, air-flow variant, ROUND FIG. 12—Kinematic diagram, air-flow variant; device 32 inserted into tank 31
Figure 9B:
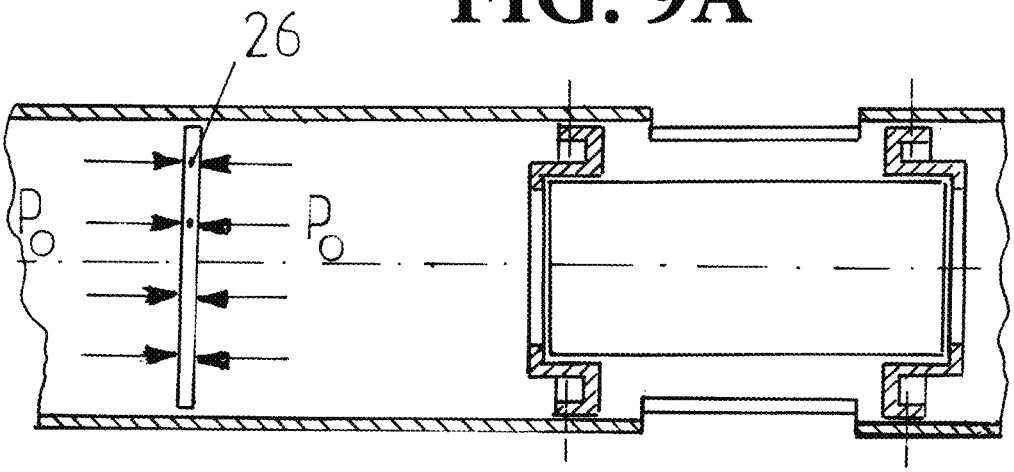
Figure 10:
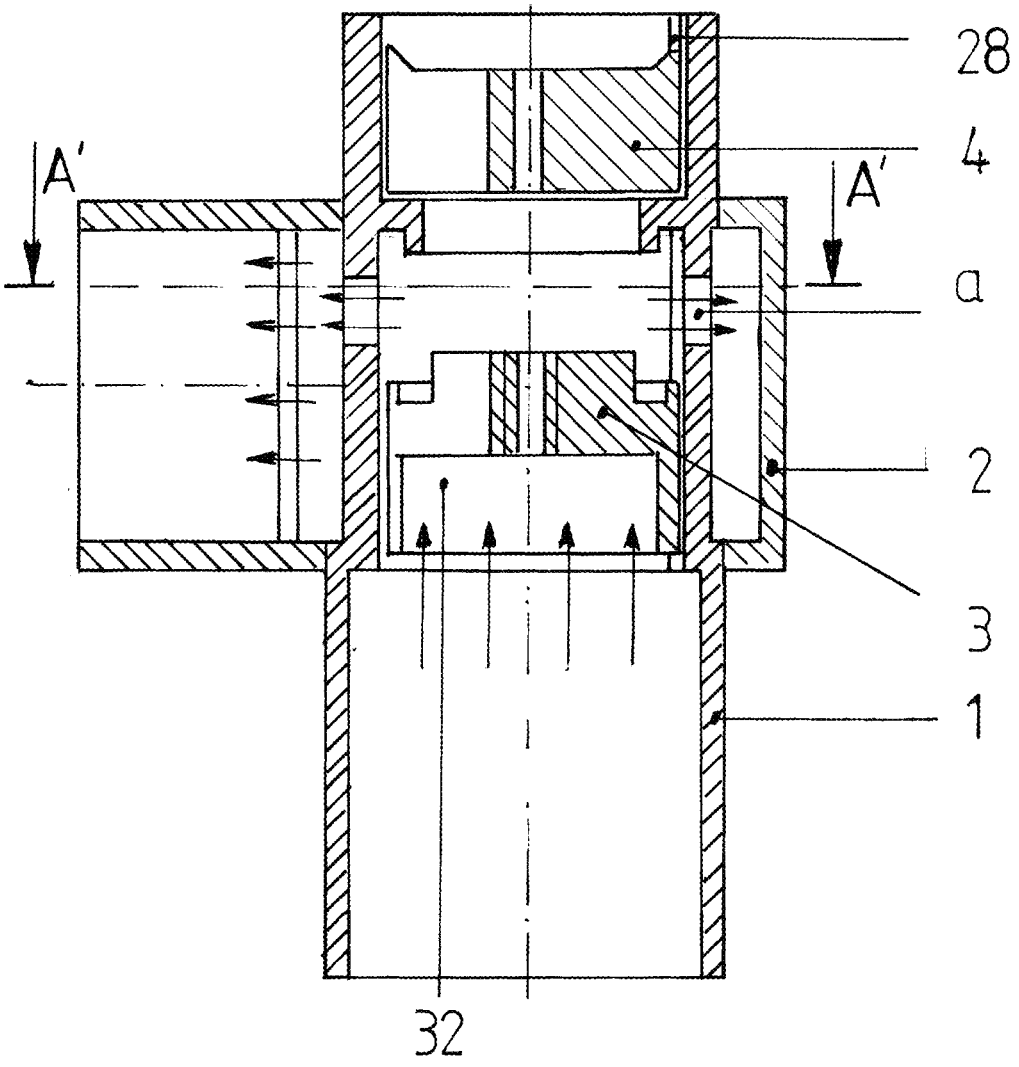
Figure 11:
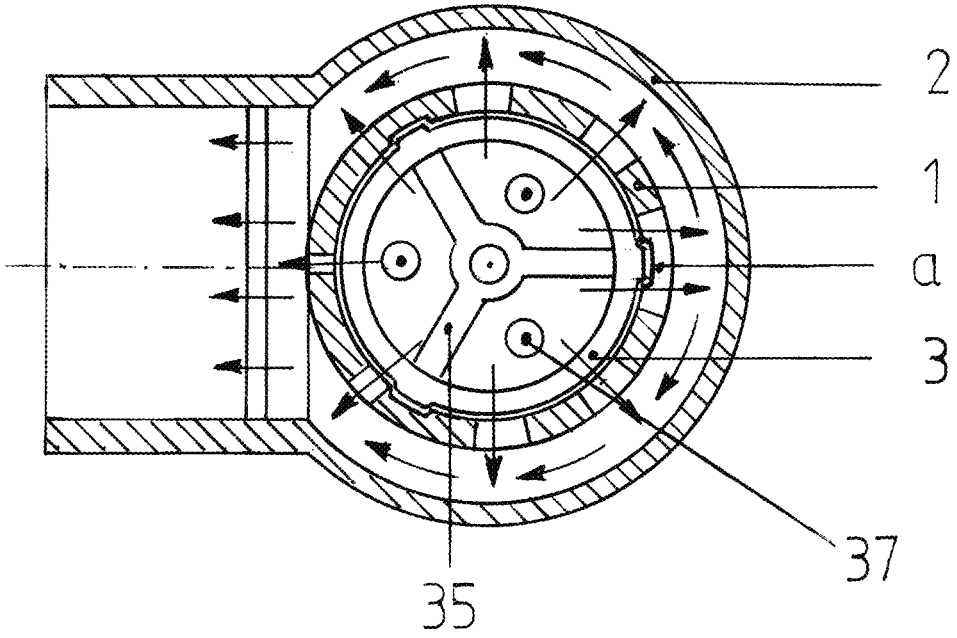
Figure 12:
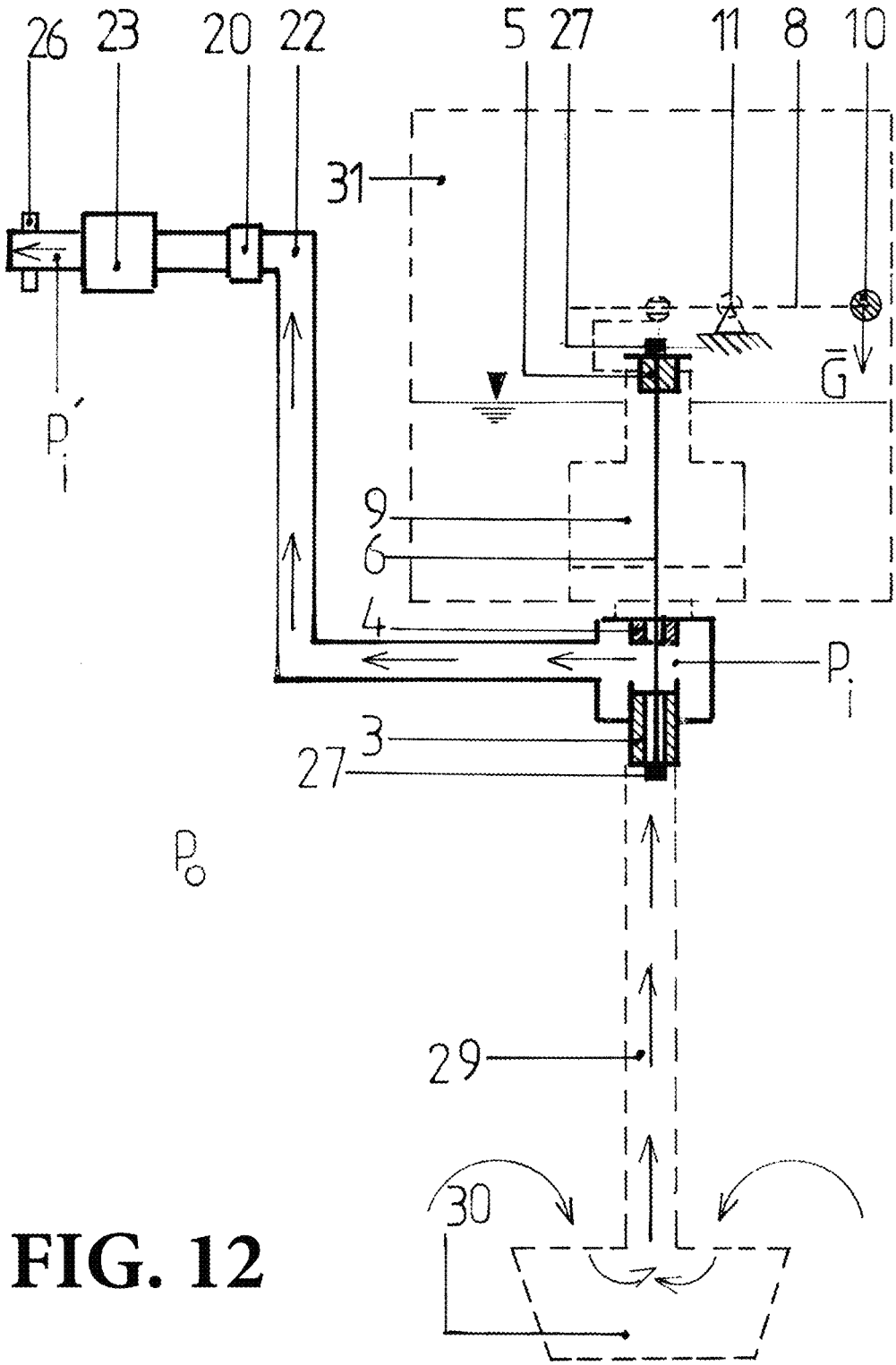
Figure 13:
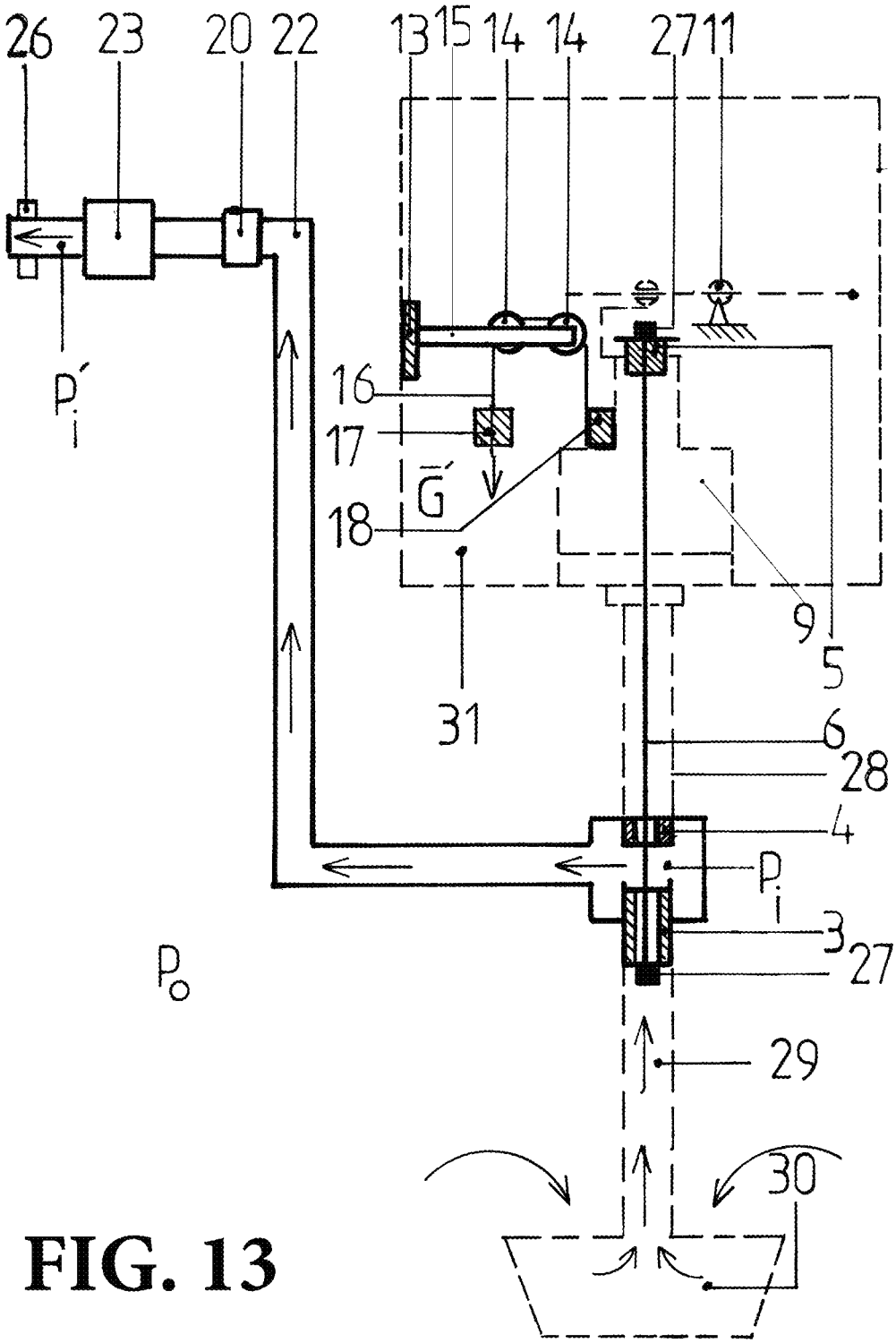
FIG. 13—Kinematic diagram, air-flow variant; device 32 fluidly connected in-line to flush pipe 29
Figure 14:
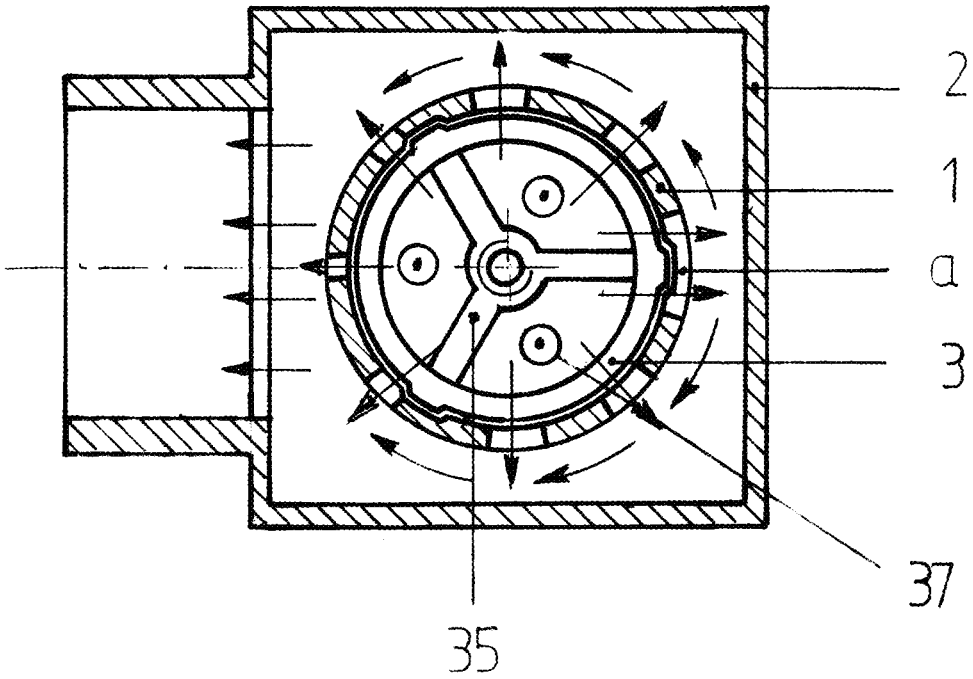
FIG. 14—Cross-section A'-A' through device 32, air-flow variant, SQUARE
Figure 15:
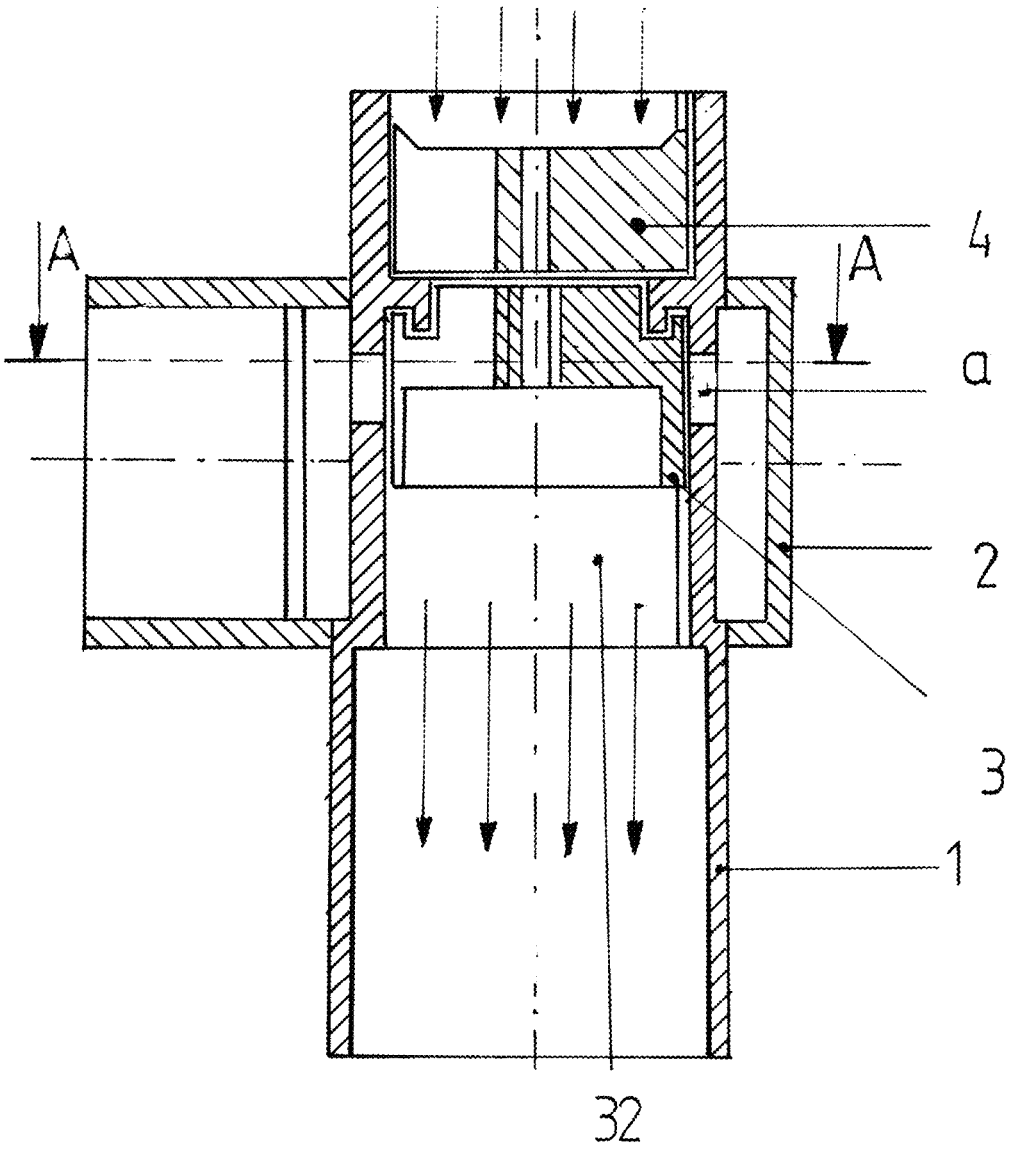
FIG. 15—Longitudinal section through device 32, water flush variant
Figure 16:
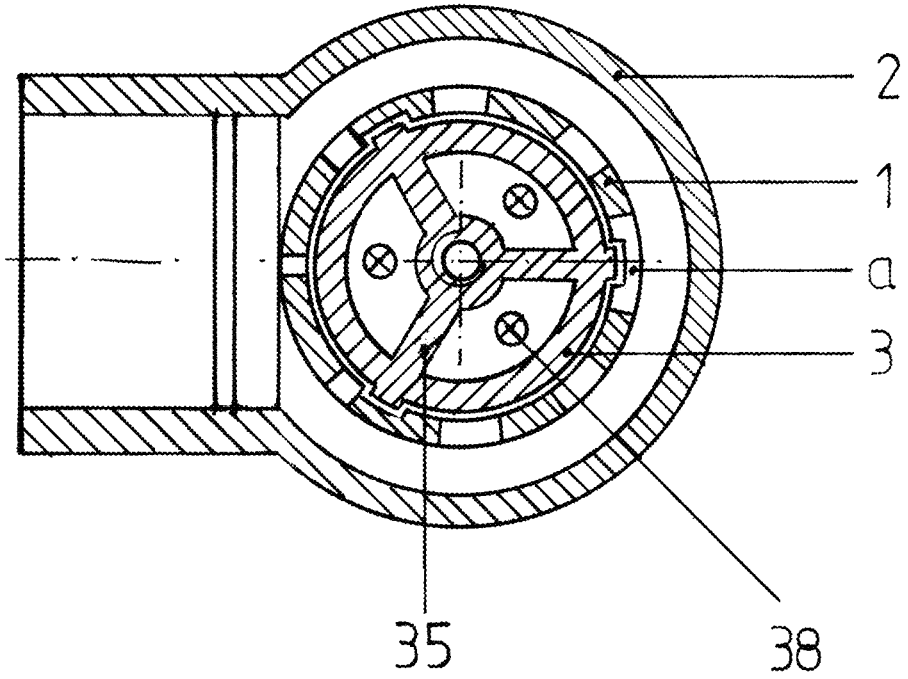
FIG. 16—Cross-section A-A through device 32, water flush variant, ROUND
Figure 17:
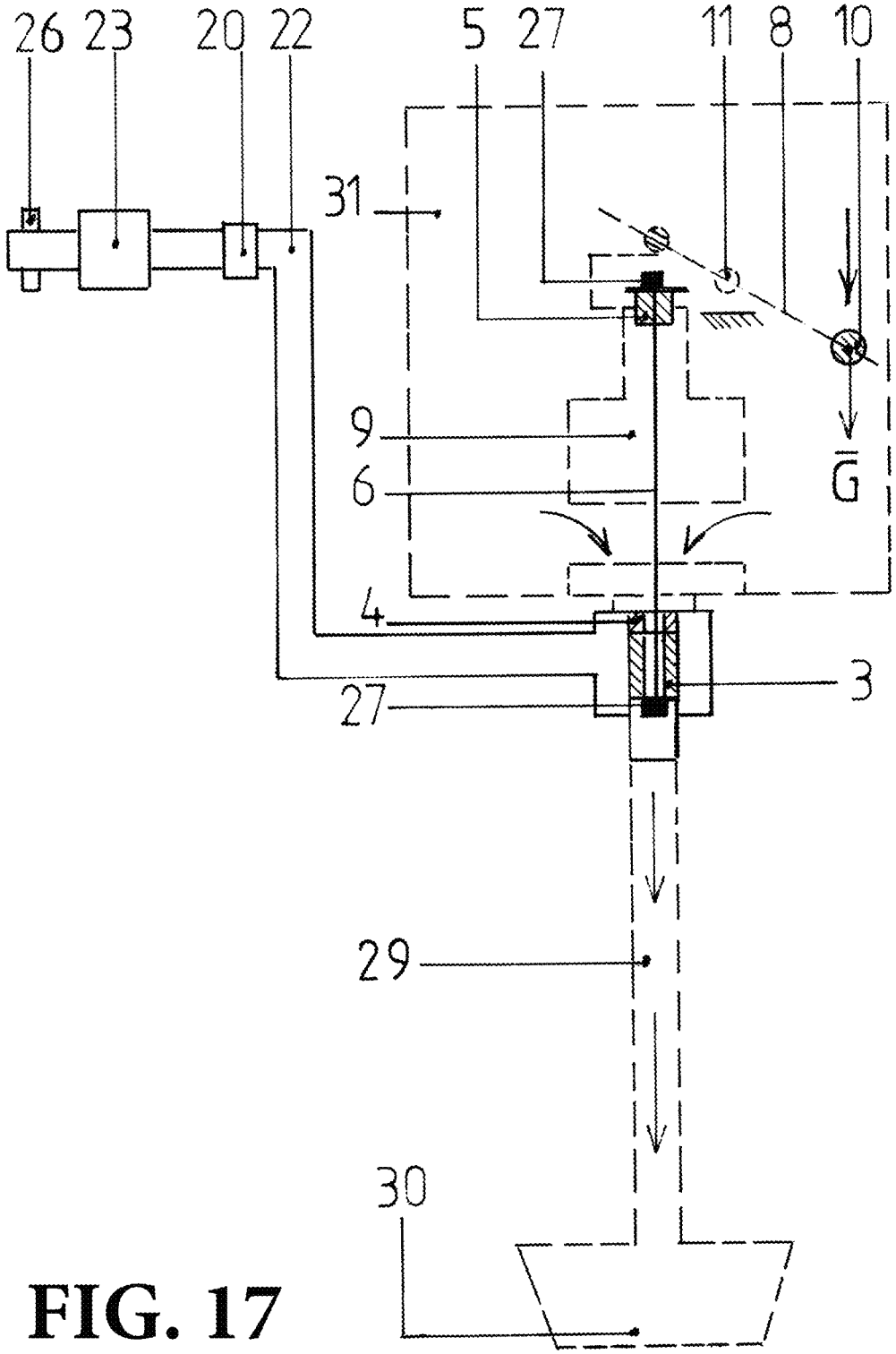
FIG. 17—Kinematic diagram, water flush variant; device 32 inserted into tank 31
Figure 18:
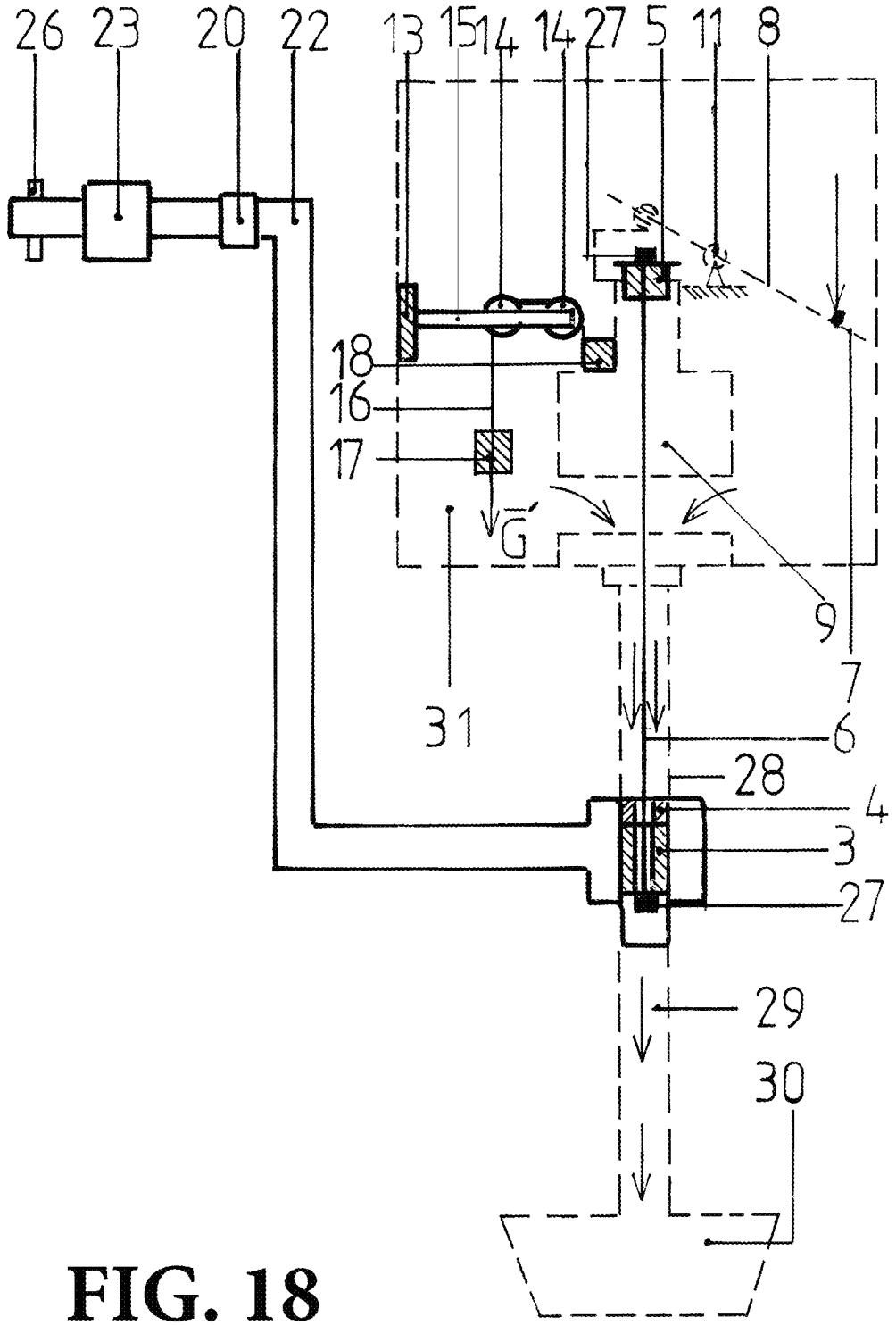
FIG. 18—Kinematic diagram, water flush variant; device 32 fluidly connected in-line to flush pipe 29
Figure 19:
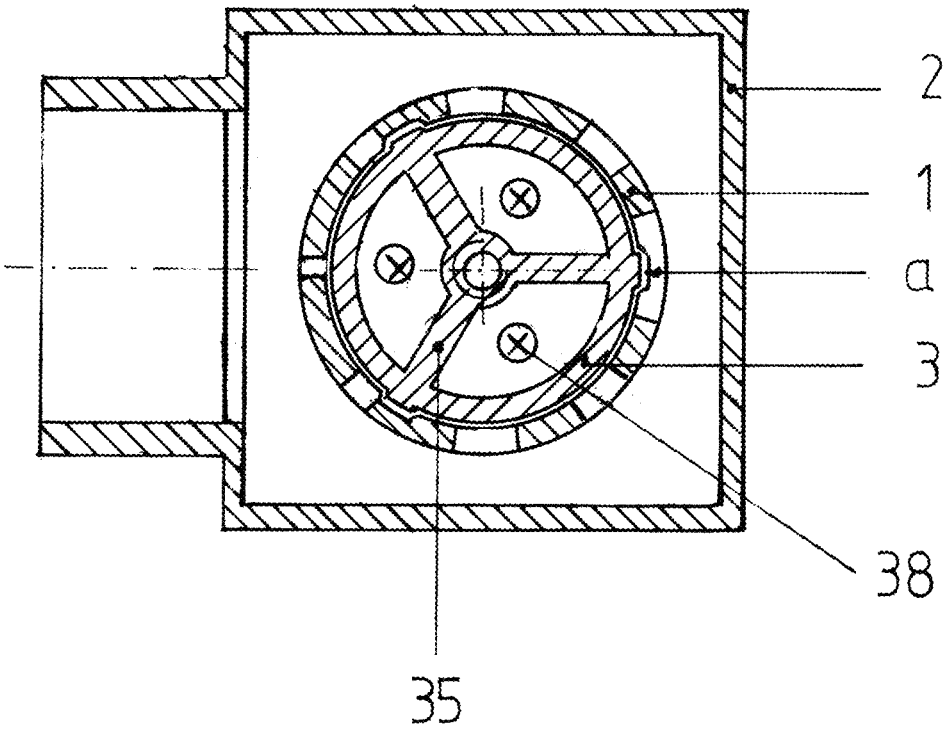
FIG. 19—Cross-section A-A through device 32, water flush variant, SQUARE

The toilet bowl cavity ventilation system according to this invention comprises a ventilation device 32—which comprises a main body 1, a secondary body 2, a cylindrical sliding bushing shutter 3, and a fixed grooved bushing 4—together with a toilet vent pipe 22, a vent tee 20, a fan 23, a backdraft damper 26, a threaded rod 6, nuts 27, and a rod end-piece 5.

The ventilation device 32 is either inserted in the tank 31, between the water tank and the flush pipe 29, or fluidly connected in-line between two sections of the flush pipe 29, without changing the dimensions of the flush assembly.

The main body 1 has a cylindrical shape on the outside and inside and is internally provided with longitudinal guide channels 28, so that the cylindrical sliding bushing shutter 3 slides when the flush lever 7 and the kinematic chain—flush lever 7, flush valve tube 9, rod end-piece 5, nut 27, threaded rod 6, cylindrical sliding bushing shutter 3, nut 27—are actuated.

The cylindrical sliding bushing shutter 3 has a grooved profile on the outside and a resistance profile on the inside, and opens or closes the radial apertures (a).

At the upper part of the main body 1, on the inside, the fixed grooved bushing 4 is guided through the channels 28 and coaxially secured, forming a single body with the main body 1, and having on the outside the same grooved profile as the cylindrical sliding bushing shutter 3 and, on the inside, a resistance profile 36 identical in shape to the resistance profile 35 of the cylindrical sliding bushing shutter 3, the whole being conjugated with the inside of the main body 1.

The inner resistance profile 36 of the fixed grooved bushing 4 has a two-sloped form, so that the water flush forces are distributed symmetrically over it; the fixed grooved bushing 4 thus takes all the stress during the water flush action, so that the water does not reach the resistance profile 35 of the cylindrical sliding bushing shutter 3, which is covered by the profile of the fixed grooved bushing 4.

The two-sloped form of the resistance profile 36 of the fixed grooved bushing 4 also facilitates the flow of the water from the tank 31 through the center of the fixed grooved bushing 4. The two bushings do not rotate, and the threaded rod 6 slides freely through the fixed grooved bushing 4.

Under the fixed grooved bushing 4, radially positioned apertures (a) are provided in the main body 1, which communicate with the outside of the main body 1 and with the inside of the secondary body 2, the latter being placed coaxially with the main body 1 and tightly mounted around it; its shape is round, square, or any other shape.

Given the increased weight of the flush valve tube 9, it is necessary to create a vertical force that balances the weight of the assembly of parts, force F, comprising the cylindrical sliding bushing shutter 3, the threaded rod 6, the nuts 27, and the supporting rod end-piece 5.

Because of this additional weight, the water from the tank 31 would be flushed incompletely; to prevent the incomplete flushing of the water from the tank 31, the following balancing possibilities are provided.

In a first possibility, the flush valve tube 9 is dimensioned for the total weight.

In a second possibility, applicable in all cases, a lever counterweight 10 is placed on the flush lever 7 at a flap arm 8 distance from the pivot axis 11, creating, by means of its weight force G, a torque equal to that produced by the additional weight force F.

In a third possibility, a pulley support bracket 13 is mounted on the tank wall 12, carrying a pulley support arm 15 on which a pulley 14 is mounted, a vertical wire 16 passing over the pulley 14 and fixed to the flush valve tube 9 by a wire-fixing support 18 through a wire end-piece 19, the other end of the wire carrying a pulley counterweight 17 whose weight force G' is equivalent to the additional weight force F loading the flush valve tube 9.

The rod end-piece 5 allows a small passage of air and thereby ensures the overflow function of the flush valve tube 9, over which it is located.

When the fan 23 is on and the flush lever 7 is not actuated, the malodorous air 37 from the toilet bowl cavity 30 is exhausted through the following components: flush pipe 29, main body 1, cylindrical sliding bushing shutter 3, apertures (a), secondary body 2, toilet vent pipe 22, vent tee 20 with access cover 21, fan 23, and backdraft damper 26.

The fan 23 is provided with two end spacer rings 25 to prevent heat transfer to the toilet vent pipe 22, which is provided with cooling slots 24 and the backdraft damper 26 that prevents the air from running in reverse when the fan 23 is not operated.

When the apertures (a) are open, the fan 23 creates a negative pressure Pi lower than the outside pressure Po; due to the pressure difference, air enters the toilet bowl cavity 30 and, drawing in the malodorous air, expels it to the outside; a small quantity of air is also drawn through the gap between the rod end-piece 5 and the flush valve tube 9, which structurally provides the latter with its overflow function. The pressure in the toilet vent pipe 22 downstream of the fan 23, Pi', is higher than the outside pressure Po, so the backdraft damper 26 opens, allowing the malodorous air to be expelled.

When the flush lever 7 is actuated, the flush valve tube 9 and the rod end-piece 5 are raised and, through the threaded rod 6 secured by the nut 27, the cylindrical sliding bushing shutter 3 is actuated; rising, it closes the apertures (a) and completely separates the malodorous air circuit from the water flush circuit, thereby preventing water from entering the fan 23.

The flush water 38 from the tank 31 then passes through the center of the fixed grooved bushing 4 and the center of the cylindrical sliding bushing shutter 3, and through the flush pipe 29, into the toilet bowl cavity 30.

The capped vent tee 20 is used for the periodic sanitation of the internal surfaces of the toilet vent pipe 22 as follows: press and hold the flush lever 7 to block the malodorous air circuit, remove the access cover 21, pour in the sanitizer, hold for a period, then release the flush lever 7.

The invention claimed is:

1. A toilet bowl cavity ventilation system for venting a toilet bowl cavity (30), toilet cubicles, or bathrooms, for use with a toilet having a water tank (31), a flush valve tube (9) raisable within the water tank (31), a flush pipe (29), a flush lever (7) pivotable about a pivot axis (11), and a toilet bowl cavity (30), the system comprising:

a toilet vent pipe (22);

a vent tee (20) having an access cover (21);

a fan (23) operable to exhaust malodorous air (37) from the toilet bowl cavity (30);

a backdraft damper (26) arranged on a malodorous air circuit and configured to prevent reverse air circulation when the fan (23) is not operated;

a rod end-piece (5) configured to be placed at a top of the flush valve tube (9), a threaded rod (6), and nuts (27); and a ventilation device (32) configured to be inserted between the water tank (31) and the flush pipe (29), or to be connected in-line into the flush pipe (29), the ventilation device (32) comprising:

a main body (1) of cylindrical shape on an outside and an inside thereof, having longitudinal guide channels (28) and a plurality of radial apertures (a) in a middle area thereof in fluid communication between an inside of the main body (1) and an inside of a secondary body (2);

the secondary body (2) sealingly mounted around and centered on the main body (1);

a fixed grooved bushing (4) arranged inside the main body (1) at an upper part thereof; and a cylindrical sliding bushing shutter (3) arranged inside the main body (1) below the fixed grooved bushing (4) and connected, by the threaded rod (6) and the nuts (27), to the rod end-piece (5), the cylindrical sliding bushing shutter (3) being movable, upon raising of the flush valve tube (9), between a lowered position, in which the radial apertures (a) are open so that the malodorous air (37) from the toilet bowl cavity (30) is exhausted, by the fan (23), through the flush pipe (29), the main body (1), the cylindrical sliding bushing shutter (3), the radial apertures (a), the secondary body (2), the toilet vent pipe (22), the vent tee (20), and the backdraft damper (26), and a raised position, in which the cylindrical sliding bushing shutter (3) closes the radial apertures (a) so as to separate the malodorous air circuit from a water flush circuit, whereby flush water (38) from the water tank (31) passes through the fixed grooved bushing (4) and the cylindrical sliding bushing shutter (3) into the flush pipe (29) without entering the secondary body (2).

2. The ventilation system according to claim 1, further comprising a lever counterweight (10) mounted on the flush lever (7) at a flap arm (8) distance from the pivot axis (11) and configured to create a torque that balances the torque produced by the weight force (F) of a moving assembly comprising the cylindrical sliding bushing shutter (3), the threaded rod (6), the nuts (27), and the rod end-piece (5).

3. The ventilation system according to claim 1, further comprising a pulley support bracket (13) mounted on a tank wall (12), a pulley support arm (15) extending from the pulley support bracket (13) and carrying a pulley (14), and a wire (16) passing over the pulley (14), a first end of the wire (16) being fixed to the flush valve tube (9) by a wire-fixing support (18) and a wire end-piece (19), and a second end of the wire (16) carrying a pulley counterweight (17) configured to counteract a weight force (F) of a moving assembly comprising the cylindrical sliding bushing shutter (3), the threaded rod (6), the nuts (27), and the rod end-piece (5).

4. The ventilation system according to claim 1, wherein the fixed grooved bushing (4) has grooves (34) and is guided through the longitudinal guide channels (28) and coaxially secured so as to form a single body with the main body (1), and the cylindrical sliding bushing shutter (3) has grooves (33) and is guided through the longitudinal guide channels (28) so as to slide along the main body (1) without rotating.

5. The ventilation system according to claim 1, wherein the fixed grooved bushing (4) has, on an inside thereof, an inner resistance profile (36) identical in shape to an inner resistance profile (35) of the cylindrical sliding bushing shutter (3), the inner resistance profile (36) being configured to shield the inner resistance profile (35) from a downforce of the flush water (38), and an upper part of the fixed grooved bushing (4) being shaped as a two-sloped roof.

* * * * *